US006929847B2

(12) United States Patent
Mabbott

(10) Patent No.: US 6,929,847 B2
(45) Date of Patent: Aug. 16, 2005

(54) TRANSFER MATERIALS

(75) Inventor: Robert John Mabbott, Bedford (GB)

(73) Assignee: Xyron UK Limited, Bolton (GB)

( * ) Notice: Subject to any disclaimer, the term of this patent is extended or adjusted under 35 U.S.C. 154(b) by 230 days.

(21) Appl. No.: 08/716,360

(22) PCT Filed: Mar. 17, 1995

(86) PCT No.: PCT/GB95/00601

§ 371 (c)(1),
(2), (4) Date: Aug. 3, 1999

(87) PCT Pub. No.: WO95/25987

PCT Pub. Date: Sep. 28, 1995

(65) Prior Publication Data

US 2003/0035930 A1 Feb. 20, 2003

(Under 37 CFR 1.47)

(30) Foreign Application Priority Data

Mar. 18, 1994 (GB) ..... 9405374

(51) Int. Cl.[7] ..... B41M 5/00

(52) U.S. Cl. ..... 428/195.1; 428/32.51; 428/211.1

(58) Field of Search ..... 428/32.51, 195.1, 428/211.1, 195, 500, 211, 219

(56) References Cited

U.S. PATENT DOCUMENTS 4,006,267 A 2/1977 Kurz et al.
4,758,461 A * 7/1988 Akiya et al. ..... 428/212
5,300,384 A * 4/1994 Rimai et al. ..... 430/47
6,198,898 B1 3/2001 Mabbott

FOREIGN PATENT DOCUMENTS

| | | | |
|---|---|---|---|
| EP | 0 191 592 | 8/1986 | |
| EP | 0 222 374 | 5/1987 | |
| GB | 1 215 599 | 12/1970 | |
| GB | 2 231 533 | 11/1990 | |
| GB | 2 273 466 | 6/1994 | |
| JP | 62 116945 | 5/1987 | |
| JP | A439090 | 2/1992 | |
| JP | 4-39090 | 2/1992 | |
| JP | 4-101841 | 4/1992 | |
| JP | 04-039090 | * 10/1992 | ..... B41M/5/38 |
| JP | 04-101841 | * 10/1992 | ..... B32B/7/06 |
| WO | WO91/02296 | 2/1991 | |

* cited by examiner

*Primary Examiner*—Bruce Hess
(74) *Attorney, Agent, or Firm*—Pillsbury Winthrop LLP

(57) ABSTRACT

A transfer material and method of use for transferring monochrome and full colour images produced by a xerographic process or dry toner printing onto a substrate. The process requires the use of film form polymethylpentene material as the transfer material which is used to transfer the xerographic or dry toner image onto the substrate with the application of heat and pressure.

8 Claims, 1 Drawing Sheet

TRANSFER MATERIALS

This invention is concerned with transfer materials and is specifically concerned with transfer materials which can be used to carry toner images for transfer onto a substrate.

More specifically, the invention relates to materials for use in or with the transfer of full colour and monochrome toner images produced by a xerographic photocopier or a dry toner printer, such as a laser printer, onto a substrate, including paper, card, cardboard, leathers, glass, ceramics, wood, metal, metallised materials, plastics materials, and film form materials and closely woven and closely knitted materials whether or not the surfaces of those materials are plain or have existing artwork thereon, or have been coated with any typical proprietary coating.

Attempts to transfer and so print images have been made previously but until now there has not been a successful attempt to provide a single 'universal' material which can be used both in xerographic photocopiers, laser printers and the like and also permit transfer of full colour images from one surface to another without the use of intermediate means such as adhesive materials and without loss of definition or colour tones or image quality.

Previously, it has been normal practice to use paper and other materials for carrying images which are copied from a photocopier or dry-ink or toner printer, but these images have, until recently, been fixed on the paper or other material as permanent images, the term "permanent" meaning that the image so formed cannot be removed from the carrier without damaging it. In addition, it is also known to transfer images onto self-supporting films for use as overhead projection slides.

In some applications, it has been possible to transfer monochrome images from such paper or the like onto another surface by using special transfer materials but not to the extent that 100% of the image can be transferred, or more importantly that 100% of a full colour image can be transferred.

In the specification of UK patent application no. 9325904.2, there is disclosed a method and material for printing monochrome and full colour images onto a surface, the method comprising the steps of (a) copying the image onto a carrier to provide a toner image on the carrier, (b) placing the carrier against film form polyethylene ester material with the toner image between the carrier and the material, (c) passing the carrier and the material through a heating station whereat, under pressure, the carrier and the material, with the toner image therebetween, are subjected to a temperature in the range of 140–160 degrees Celsius, (d) thereafter removing the carrier from the material, with the toner image wholly transferred to the material, (e) placing the material against a surface of a substrate onto which the toner image is to be ultimately transferred with the toner image therebetween, and (f) passing the material and the substrate through a heating station whereat, under pressure, the material and the substrate, with the toner image therebetween, are subjected to a temperature in the range of 140–160 degrees Celsius to transfer the toner image from the material to said substrate, the polyethylene ester material having thermal shrinkage characteristics of less than 1.0%.

The polyethylene ester material is exceptionally useful for printing images onto virtually any surface from an original image formed on paper in a copier or laser printer. However, the polyethylene ester material can not be used in the copier or printer itself and this requires that two separate sets of materials are required for image transfer, namely the one for carrying the initial image and the other for actually transferring the initial image to some other substrate.

With state of the art copiers and laser printers, it is possible to produce mirror images in the copiers themselves and for those mirrored images to be printed. Having that facility, it is then desirable to carry that image directly from the copier or printer onto a medium that will permit transfer of the image directly from the medium onto a substrate that is intended to carry the image permanently, e.g. the surface of a packaging blank.

UK patent specification no. 1215599 discloses a method of reproducing images on objects unsuitable for passage through an electrostatic copying machine, comprising: passing a sheet of material through a xerographic copying machine so that charged particles are distributed over the sheet of material in a pattern corresponding to the image to be reproduced; heating the sheet to cause the particles to adhere to the sheet; and subsequently placing the image-bearing surface of the sheet in contact with a further surface on which the image is required to be reproduced and applying heat and pressure to the said contacting surfaces until the particles transfer from the said sheet to the said further surface and fuse to the latter whereby, on separation of the surfaces the fused pattern of particles is exposed on the said further surface. The method is said to be useful in forming images on surfaces of metal, glass, tiles, wood and fabric, and for forming transparencies such as overhead projection (OHP) foils.

The specific description refers to the use of a film material which may be a triacetate film or a proprietary film known as 'Melinex' film (MELINEX is a Registered Trade Mark of ICI Ltd.), heated during image transfer to a temperature between 80° C. and 100° C.

On page 2 at lines 4 to 8 of the aforesaid UK patent specification, it is stated that 'It is of course unnecessary for all the particles on the sheet to transfer to the surface on which the image is to be reproduced; it is sufficient if a substantial proportion of the particles is transferred', which is, of course, suitable for the purposes for which the invention was intended, namely the production of acceptable monochrome images in cases where the precision of image is not critical, but not for the total clarity and definition of full colour images such as can be achieved by the present invention.

In U.S. Pat. No. 4,006,267, the invention is concerned with a method of colour highlighting an image on a xerographically produced copy by superimposing a colourant layer onto a monochrome image from a transfer donor, of Mylar film (MYLAR is a Registered Trade Mark of du Pont Corporation) or Lexan film (LEXAN is a trade mark of General Electric Company).

This disclosure describes the addition of colour to an existing monochrome image to provide background colour only. It does not teach the transfer of full colour images such as can be achieved by the present invention.

European patent application no. 191592 discloses a process of transferring metallic foils onto xerographic images which comprises a selective transfer process characterised by the steps of: providing a receiving substrate comprising xerographic images and a foil transfer sheet; placing the receiving substrate comprising xerographic images in face-to-face contact with the foil transfer sheet, to form a sandwich with the xerographic images on the inside; applying heat and pressure to at least one of the receiving substrate and the foil transfer sheet to cause the xerographic image to become tacky and the foil to selectively adhere to the images, resulting in a decorated receiving substrate; and stripping the foil transfer sheet away from the decorated receiving substrate.

In carrying out a process according to the invention disclosed in this European patent application, adhesive material is employed to transfer the xerographic images formed on paper to a receiving substrate which comprises a multi-layer assembly which may include a layer of metallic foil and/or a coloured layer so that the transferred images are positioned on a decorative background (i.e. the receiving substrate). The use of adhesive material normally creates a 'frame' which is undesirable where a clean image is required.

However, there is no disclosure which teaches the transfer of full colour images as taught by the present invention.

Polyethylene naphthalate (PEN) film has existed for a number of years and was developed in film form for use in a number of applications including uses such as overhead projection foils or films and insulation on printed circuit boards.

In European patent application no. 222374, there is disclosed such an application of the use of PEN film. In this particular publication, there is described and claimed a film form polyethylene 2,6-naphthalate film, of thickness 0.5 to 6 microns, which has a thermal transfer layer coated on one of the surfaces of the film. The film is described as being dimensionally stable. The method of printing using this film form material is that referred to as thermal transfer printing in which the thermal transfer layer is placed while supported by the PEN film against a paper sheet while a thermal head is used to soften the material of the layer to an extent that it is transferred to the paper sheet thereby to form characters or images.

This European patent application further states (q.v.page 4) that by using three separate PEN films each having a layer of a primary colour thereon, it would be possible to build up an image on the paper sheet which is in full colour.

However, the specification of this application does not say how this would or could be achieved and the specific examples to which reference is made refer only to a typewriter ribbon made from material as claimed (q.v.p. 15). Certainly, if a full-colour and complete image transfer could have been achieved on a commercial scale, then it would, because there always has been a demand for a solution to full colour transfer even if it had been a multi-stage operation of laying down-each primary colour in turn.

In Japanese published application no. 62-116945 filed on 16 Nov. 1985 by Diafoil Kabushiki Kaisha, there is disclosed film for use in electronic photography which is provided by polyethylene-2,6-naphthalate film described as having a maximum specific shrinkage factor and a minimum lengthwise and transverse Young's modulus. The film is claimed to have a thermal stability and other properties which permit it to be used to form overhead projection (or OHP) films which can be fed from a stack into a photocopier. In the published application the OHP film is described as being either a transparent film on its own or, when transfer qualities are required, as being coated by application of 'a water system dispersing agent or water soluble resin having adhesive qualities . . . '. It is further stated in relation to the Practical Embodiment 1 disclosed in this publication, that a PEN film of 50 p thickness was evaluated using a Canon pc-10 dry electronic monochrome photographic copier (q.v. page 4). As recounted from the results of Table 2, where the film was fed through the copier from a stack, on a scale of 0 to 5 where 5 represents optimum results, toner transfer was rated as 4 (q.v. page 5). Such results do not indicate the way to full colour, complete, image transfer.

More recently than any of the above prior publications, a recent development by Minolta has been announced in which it is alleged that colour pictures and illustrations can be transferred onto 'virtually any material'. This development relies upon the forming of an original image on a 'special transparent plastic sheet' onto which a bonding agent is sprayed over the image and the surface of the transparent plastic sheet. The image is then transferred by pressure onto the surface of the material intended to carry the image.

This system is described as operating in a fashion similar to that of an instant lettering system in that the image is transferred by rubbing the rear surface of the plastic sheet so that the bonding agent or adhesive is transferred to the material with the image bonded thereto.

This system demands the use of adhesive with the attendant disadvantages associated therewith and referred to above.

A further recent development has been suggested by Warner MDS Color of Salt Lake City, Utah, U.S.A., in which a toner image created in a photocopier can be transferred onto aluminium printing plates from plastic sheet material onto which the toner is copied initially. However, this development is only useful with black toner and has been primarily designed for use in the printing industry.

In none of the prior art known to the applicant is there any suggestion. other than in published UK patent application 2231533A discussed below, that any of these disclosures could be used for or result in the complete transfer of a full colour image onto a desired substrate as can be performed using a material or a method according to the present invention. In fact, the prior art appears to accept from the provision of colour-enhanced images, that obtaining transfer of full colour images was not hitherto achievable.

Certainly, the only attempt to do so was not successful because it did not achieve acceptable complete image transfer nor could it.

In the specification of UK patent application no. 2231533 (now abandoned), it was proposed to form artwork by a method which comprised the steps of generating xerographically a right-readable image on a surface of a transfer medium (i.e. a silicone coated sheet), and transferring the image, as a mirror image, onto an intermediate carrier (notably of polyethylene terephthalate film material) under heat and pressure, pressure being applied by a hand held roller having a surface temperature of 'about 160 degrees Celsius'. The image was then reported to be finally transferred as a right readable image onto the surface onto which it was to be finally applied by application of heat and pressure as before.

The aforementioned application was abandoned and it is known to the present applicant that it was so abandoned because such results as were achieved were not of commercially acceptable quality. An example of a transferred image produced by carrying out the method as described in the aforementioned specification is shown in FIG. 1 of the accompanying drawings. In carrying out the method to produce this image, a grid was copied onto an intermediate carrier of film form polyethylene terephthalate material of 23 microns thickness (such material is available from ICI plc under its trademark 'Melinex' as 'Melinex' S general purpose film). The film was heated, as the initial image was transferred to and from it, to 160 degrees Celsius. It was found that there was very measurable distortion of the image which became more marked towards the bottom of the image but which was shown to exist both laterally and vertically of the image, being very marked in the bottom right-hand part of FIG. 1.

The present applicant is also aware that the use of polyethylene terephthalate film under various conditions did not produce a clear image transfer at any stage.

In contrast, it has now been discovered that the use of a material comprising polymethylpentene material not only allows the problem of distortion to be overcome but also allows transfer of full colour images to be effected directly or indirectly from a photocopier or printer onto any desired suitable surface.

DETAILED DESCRIPTION OF THE INVENTION

Figure 1:
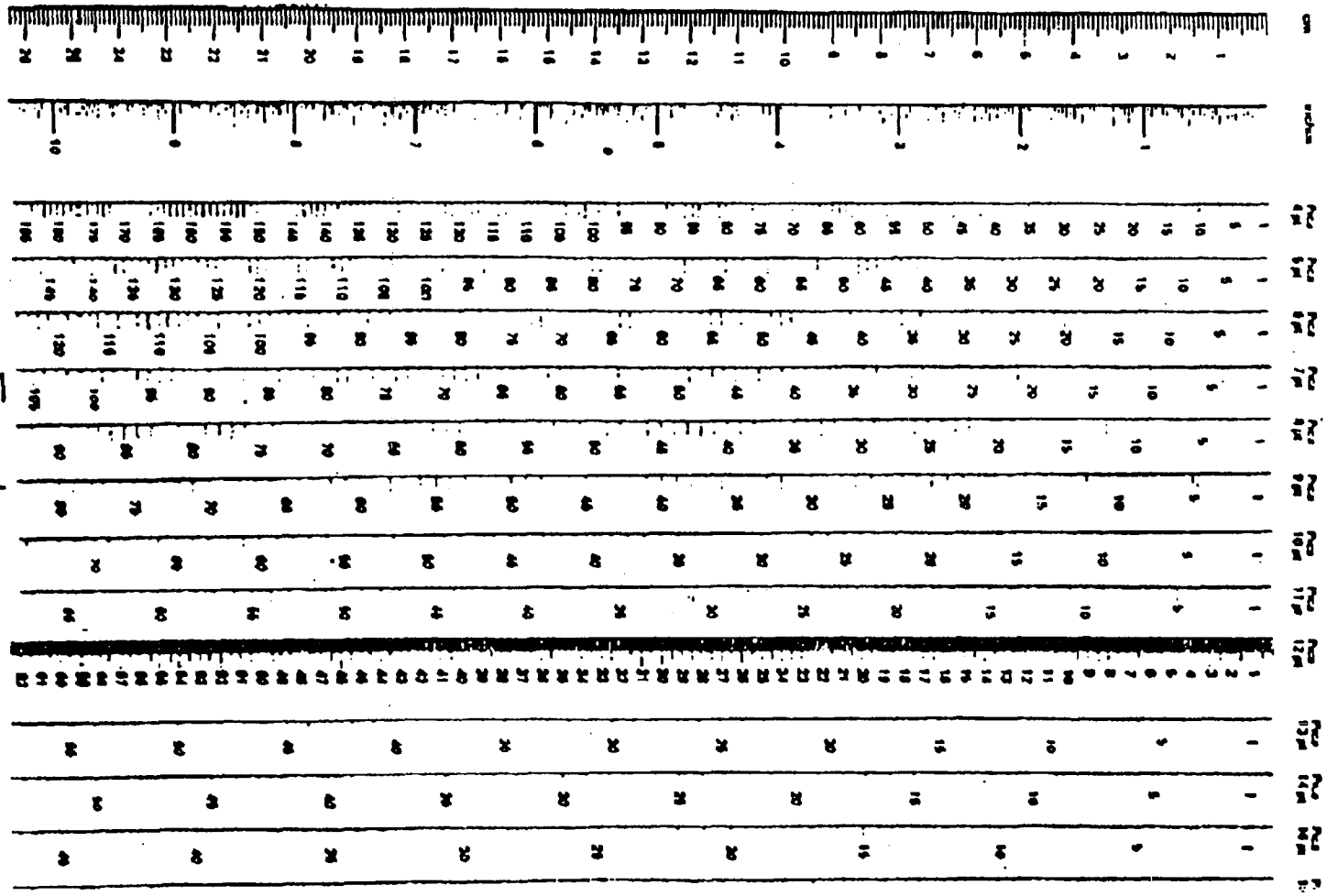
FIG. 1 is an example of a transferred image produced as described above.

The present invention provides a material for transferring an image onto a substrate, the material comprising a carrier providing a surface on which an image can be created or onto which a preliminary transfer of an image can be made, said surface being provided by film form material comprising polymethylpentene material or by a supported layer or coating of polymethylpentene material, and the layer or coating being applied at a substantially uniform thickness. Preferably, the layer or coating of polymethylpentene material is applied to its support at a weight in the range of about 10 grams/$m^2$ to about 30 grams/$m^2$ and more preferably at a weight of 25 grams/$m^2$.

Polymethylpentene material has found a wide variety of uses, including medical instruments, electrical components and insulating materials. It is produced by the polymerization of 4-methylpentene-1 monomer, is heat-resistant and transparent and exhibits the properties of noncrystalline resins but also has good chemical resistance, electrical properties and can be readily moulded, which characteristics are notable characteristics of crystalline polyolefins. It also has very good flow properties and gas permeability.

For use in image transfer, and with suitable film thicknesses for effecting image transfer, it has been found necessary to provide the coating or layer of polymethylpentene (hereinafter referred to for the sake of convenience only as "film form PMP") on a backing sheet. This is achieved by coating the backing sheet with polymethylpentene material to provide a substantially uniform layer thereof on the backing sheet using traditional methods. It has been found that a suitable coating thickness is that which is produced by coating the layer to provide a weight of 25 grams/$m^2$. A suitable material for the backing sheet is paper, preferably of 90 grams/$m^2$ to 110 gram$^2$, and more preferably 95–105 grams/$m^2$ weight.

The present invention also provides a method of printing monochrome and full colour images onto a substrate having a continuous surface, the method comprising the steps of (a) forming an image created by a xerographic copier or a dry toner printer on an image carrier providing a surface of a material comprising polymethylpentene material to provide a toner image on the image carrier, (b) placing the image carrier against the surface of the substrate with the toner image between said surface of the image carrier and the substrate, the substrate having a greater affinity for the toner than the image carrier when the toner is heated;

(c) heating the image carrier and substrate, with the toner image therebetween, under pressure;

(d) thereafter removing the image carrier from the substrate, with the toner image wholly transferred to the substrate.

"A preferred material for the image carrier is film form material comprising polyethylene naphthalate material."

The image carrier referred to in the last paragraph is a material according to the present invention and can, if required, be used as one of a stack of sheets of the material of say A3 or A4 size on the paper tray of a copier or of a printer, such as a laser printer, from which the sheets of material can be fed into the copier to have toner images formed thereon. If the handedness of the image is unimportant or if the copier or printer is capable of creating mirror images, then each sheet can be used, in accordance with the above method, to transfer the toner image directly onto a substrate as a correctly-handed image.

In forming an image in a copier or printer using dry toner, temperatures of between 100–200 degrees Celsius may be encountered depending upon the type of copier or printer that is being used.

In performing step (c), the image carrier and the substrate, with the toner image therebetween, can be subjected to a temperature in the range of 100–200 degrees Celsius, e.g. by passing the image carrier and substrate through a heating station, under pressure. However, it has been found by experiment that, using film form PMP, any fixed temperature within that range can be used to transfer the toner from one carrier to another, and we have carried out a method according to the invention using a fixed temperature of 160 degrees Celsius.

In carrying out a method according to the invention, we believe that the PMP material which underlies the image (i.e. lies between the image and the support material) migrates into the toner material or vice versa; elsewhere, the PMP material is largely unaffected. Certainly, when an image has been formed and printed onto film form PMP material in a copier or dry toner printer with the application of heat which softens the PMP material as it passes through the copier/printer, and the composite so produced is examined closely, there is no evidence of any definable surface interface between the toner and the PMP material indicating that migration has taken place.

"Examination of the mirror toner image, when cool, as it appears on the surface of the image carrier has revealed that the external surface of the image is hard, of somewhat crystalline appearance when viewed under a microscope and is resistant to scratching. It is believed that this is due to the presence of PMP material which exhibits crystalline properties.

We have found that toner image transfer under the application of heat from a sheet of material according to the present invention appears to have resulted in the underlying PMP material bonding to the toner material more strongly than it bonds to PMP material at the periphery of the image and to the supporting material and, where the toner material itself is transferred from the sheet of material, so also is the underlying PMP material.

The mechanism by which this occurs is not fully understood but it has been observed that where the polymethylpentene coating is applied as a smooth, glossy finish, as compared with a matt or satin finish, to the underlying support, application of toner material under the application of heat to the polymethylpentene material and subsequent transfer thereof affects the surface finish of the material and leaves a matt area and silhouette where the toner image has been transferred. It is not known to the applicants if this effect is caused simply due to softening of the film form PMP material beneath the toner during heating or whether some or all of the film form PMP material reacts with the toner material or becomes absorbed by the toner material and perhaps forms a matrix and is thus transferred from the paper. A further possibility is that the film form PMP crystallises under the application of heat and that in crystallising, the crystalline form is partially absorbed into the toner and consolidates the toner. It is, however, believed that the film form PMP keys to the toner material and is entirely removed from the underlying support where the toner image is in contact with the PMP material, so that when the image is transferred under the application of heat to a substrate direct from a material according to the invention, the polymethylpentene material forms and so provides an exposed surface which is hard and resistant to scratching (due to its observed crystallinity) while the underlying material, albeit the toner material alone or in combination with any of the PMP material which has permeated the thickness of the toner material, bonds strongly to the surface of the substrate.

It is also observed that the PMP material which is associated with the toner in the transferred image assists in providing a very strong bond between the image and whatever substrate the image is finally transferred to. It has also been found, in carrying out methods according to the present invention, that, when the image has been examined, after transfer to the intermediate image carrier, the exposed surface of the image has enhanced scratch-resistance.

For some materials, such as glass and ceramics it has been found that the bond of the image to the substrate is enhanced by the application of, for example, a polyvinyl acetate coating either to the substrate before application of the image under heat, or to the surface of the image before it is transferred from the second or intermediate carrier onto the substrate.

The present invention further provides a method of printing monochrome and full colour images onto a surface, the method comprising the steps of (a) forming an image created by a xerographic copier or a dry toner printer on a first image carrier to provide a toner image on the first image carrier, (b) placing the first image carrier against a surface of a second image carrier with the toner image between the first image carrier and the second image carrier, the surface of the first image carrier being provided by polymethylpentene material and the second image carrier having a greater affinity for the toner than the first image carrier when the toner is heated;

(c) heating the first and second image carriers, with the toner image therebetween, under pressure;

(d) thereafter removing the first image carrier from the second image carrier, with the toner image wholly transferred to the second image carrier;

(e) placing the second image carrier against a surface of a substrate, onto which the toner image is to be ultimately transferred, with the toner image therebetween, the substrate having a greater affinity for the toner than the second image carrier;

(f) heating the second image carrier and the substrate, with the toner image therebetween, under pressure; and (g) thereafter removing the second image carrier from the substrate, with the toner image wholly transferred to the substrate.

Preferably the temperature range for carrying out either one or both of steps (c) and (f) is 165–195 degrees Celsius, and more preferably each of the steps is carried out at a mean temperature of about 180 degrees Celsius. "About 180 degrees Celsius" means +/−5 degrees Celsius.

The use of PMP material permits complete transfer of the toner from its initial carrier onto many other surfaces including of paper, card, cardboard, all of which may be uncoated or coated with many different types of finish. and of glass, ceramics, woods, metals (including aluminium, brass, tin, steel and iron), metallised surfaces, plastics materials (e.g. polypropylenes, PVC's, polyesters, acrylic materials, polyethylenes) and film form materials, and leathers, fabrics and textile materials.

In addition to being dimensionally stable as mentioned above, it has been found that PMP material has sufficient thermal stability to be useful within the range of temperatures at which the material can be used for effecting image transfer.

Furthermore, the preferred PMP material is transparent thus allowing correct visual registration of an image on the material on an 'underlying' surface of the substrate onto which the image is to be transferred.

It has also been found that the transfer characteristics of the aforementioned PMP material are such that it is possible to intensify a full colour image formed on a surface by carrying out a method according to the present invention and then repeating the process by overlaying a second identical image onto the first, due to the dimensional stability of the PMP material, without damaging the integrity of the first image formed on the surface.

From experiments which have been carried out employing methods according to the invention, it has been observed that there is a full and complete image transfer onto whatever substrate is selected with no loss at all in image quality or in change of contrast, hue or texture in the colours of the transferred image.

In carrying out methods according to the present invention, the initial image formed by a copier or dry-toner printer is printed onto material according to the invention which is passed through the copier/printer so that the toner image is carried by the surface of the PMP material.

The application of heat to effect transfer of the image is preferably carried out using a heated roller unit to heat the toner image to a temperature in the range of 140–200 degrees Celsius. One or both of the rollers of the unit may be heated. Obviously, the temperature which is applied will be dependent on the rate of traverse though the heating unit. We have found that with a feed rate of 2.5 cm per second, a registered roller surface temperature setting of the order of about 180 degrees Celsius has resulted in complete transfer of the toner image from the polymethylpentene surface to substrates of paper, card, cardboard, glass, ceramics, wood, metal, metallised surfaces, fabrics and plastics materials.

Once the image has been transferred to the substrate, a method according to this invention enables the use of a variety of image enhancement techniques for the toner image, depending also on the optical properties of the materials used. Toners, according to their colours, may be more or less transparent or translucent to light and images can be altered or enhanced accordingly. By the deposition of additional layers of toner or other materials having the desired optical properties selectively over the entire image surface, onto toner alone, or onto defined regions of the image surface or of the toner, a wide variety of effects can be achieved.

The layers having the desired optical properties can be conveniently deposited from appropriately-constructed commercially-available film form materials. In their simplest form, these film form materials comprise a backing sheet of thin polyester film with a coating of clear, heat-activated release agent supporting the layer in question. With the film form material correctly positioned over the toner image on the target surface, heat and pressure are applied to transfer the layer from the backing sheet to the target surface. Suitably, the described heated roller arrangement can be used for this purpose. The backing sheet is then simply peeled away. To prevent any possibility of curling of a material according to the present invention when heated, the reverse side of the material, i.e. the surface of the supporting paper which is not coated with the PMP material, may be coated with polyethylene or similar material.

One example of a commercially available film form material to be used in this manner is one for the purpose of changing the colour or appearance of a particular toner image. A transfer foil typically has the construction:

Polyester carrier film (12 micron)

Clear heat-activated release agent

Clear lacquer

Pigment layer(s)

Heat-activated adhesive

The properties of the heat-activated release agent and adhesive are carefully selected such that, at the chosen values of heat and pressure, the pigment layer is deposited upon regions of exposed toner but not elsewhere. The clear lacquer then forms the upper surface and gives a gloss finish. Of course, the lacquer layer can be omitted if a matt finish is required. The pigment layer will typically be a homogeneous layer also including extenders and heat-activated adhesive which may supersede the adhesive layer per se in some instances.

Using PMP material it is possible, for example, to colour a black toner image in a similar manner to that described in the aforementioned European patent application no. 222374 and in the aforementioned U.S. Pat. No. 4,006,267 or to change the colour of a colour toner image which has been already formed. In a case where monochrome colour separations are available (similar to that disclosed in European patent application no. 222374), successive monochrome toner images can be transferred and with the use of a correctly pigmented layer, changed to the correct colour of the separation. In this way, it will be possible to generate a colour toner image from the output of an entirely monochrome printing or copying process. More generally, the optical properties of a transferred toner image can be widely varied and not merely through a change of colour. A metallic foil may—for example—be employed to increase the reflectivity of a toner image. A typical commercially available metallic foil construction is:

Polyester carrier film (12–23 microns)

Clear heat-activated release agent

Translucent coloured lacquer

Vacuum deposited aluminium

Heat-activated adhesive.

In many cases, it will be useful to be able to change the properties of the uppermost toner layer whilst leaving undisturbed one or more underlying layers. This is achieved in carrying out a method according to the present invention by sealing the underlying layer or layers with a lacquer, prior to transfer of the toner layer which is to be enhanced. Conveniently, a lacquer coating can be deposited using the foil technique, described above. Thus a suitable foil has the construction:

Polyester carrier film

Clear heat-activated release agent

Clear lacquer

Heat-activated adhesive

The manner of use of the lacquer foil is as described above. Once a lacquer coating has been applied, toner layers beneath the lacquer are "fixed" and will not be affected by subsequent processes.

The lacquer layer may comprise translucent dye material to achieve whatever colour is desired of the lacquer layer.

It has been described how the optical properties of any one or more toner layers can be enhanced by the deposition of appropriate lacquers, pigments or metallic films over the toner layer. The present invention also contemplates the deposition of image enhancement layers beneath a particular toner layer, whilst still being confined to the regions of the image where toner is present. This is achieved, ingeniously, by the deposition of the appropriate enhancement layer (conveniently still using the described foil technique) on top of the toner layer, whilst the toner layer remains on the polyethylene ester transfer film. Then, when the process is completed with the transfer to the target surface, the image enhancement layer is beneath (i.e. backing) the toner layer.

One application of this backing technique is to transform a transparent image into an apparently solid image, for example by the addition of a white backing layer. The image can then be transferred to a target surface of any colour, without the danger of contrast being lost. It will be recognised that the backing layer extends uniformly over the toner image, filling in small gaps between toner regions. This feature provides a second application of the backing technique, which is to increase the quality of an image by depositing black (or the appropriate colour) behind a region of black toner which through imperfections in the original copying process, is not as uniform as is very frequently required.

The foils which are suitable for the backing technique are similar to the transfer films described above. They share the property, for example, that, due to the presence of release agent, they do not adhere to areas which are totally free of toner. Foils for backing must, however satisfy the additional criterion that the upper surface of what is deposited must adhere well to the target surface. A suitable backing foil construction would be:

Polyethylene ester carrier film

Clear heat-activated release agent

Pigment layer (usually black or white)

Heat-activated adhesive

It will be seen that the uppermost layer, after deposition, is the pigment layer and not a lacquer.

Another family of techniques employs foils which adhere uniformly over the entire substrate and not merely to toner regions. These base foils are typically used to apply a pigment or metallic layer to a target substrate prior to the transfer of toner layers. Masking can be employed, however, so that a base layer is deposited on top of defined regions of a toner image providing—for example—a contrasting border or frame for the image.

We have also found that when an image has been transferred onto the surface of a substrate by a method according to the present invention, it is possible to protect that image by applying, under heat and pressure, a layer of a material according to the present invention.

According to another aspect of the present invention, there is provided apparatus comprising heating means and pressure applying means for use in and when working in accordance with a method according to the present invention. In the embodiment in which the method comprises passing materials through a heated roller unit, apparatus according to the present invention comprises the roller unit and control means for controlling power supply to one or both of the rollers for heating and rotating the rollers and for controlling the pressure applied at the nip of the rollers.

What is claimed is:

1. An image transfer carrier for transferring an image onto a substrate, said carrier comprising:

a backing sheet; and an image transfer layer comprising polymethylpentene, the image transfer layer being applied directly on the backing sheet to provide a surface onto which a toner image can be formed with the toner fusing with portions of the image transfer layer;

the direct application of the image transfer layer to the backing sheet facilitating release of the portions of the image transfer layer with toner fused therewith to a target object in an image transfer operation wherein the carrier is heated and pressed against the target object and then removed therefrom to leave the portions of the image transfer layer with the toner fused therewith on the target object.

2. A carrier according to claim 1, wherein a reverse surface of the paper opposite the image transfer layer has a layer comprising polyethylene.

3. A carrier according to claim 1, wherein the backing sheet is paper.

4. A carrier according to claim 3, wherein the paper is of a weight in the range of 90 grams/$m^2$ to 110 grams/$m^2$ and the image transfer layer is of a weight in the range of 10 grams/$m^2$ to 30 grams/$m^2$.

5. A carrier according to claim 4, wherein the image transfer layer is of a weight of 25 grams/$m^2$.

6. A carrier according to claim 5, wherein the paper is of a weight of 100 grams/$m^2$.

7. A carrier according to claim 4, wherein the paper is of a weight of 100 grams/$m^2$.

8. A carrier according to claim 1, wherein the image transfer layer is applied at a uniform thickness.

* * * * *